US009108103B2

(12) United States Patent
Nobil

(10) Patent No.: US 9,108,103 B2
(45) Date of Patent: Aug. 18, 2015

(54) SNOW DEFLECTOR FOR SKIS

(71) Applicant: John B. Nobil, La Jolla, CA (US)

(72) Inventor: John B. Nobil, La Jolla, CA (US)

( * ) Notice: Subject to any disclaimer, the term of this patent is extended or adjusted under 35 U.S.C. 154(b) by 83 days.

(21) Appl. No.: 13/779,720

(22) Filed: Feb. 27, 2013

(65) Prior Publication Data

US 2013/0229006 A1 Sep. 5, 2013

Related U.S. Application Data

(60) Provisional application No. 61/606,732, filed on Mar. 5, 2012.

(51) Int. Cl.
*A63C 11/20* (2006.01)

(52) U.S. Cl.
CPC ..... *A63C 11/20* (2013.01)

(58) Field of Classification Search
CPC ..... A63C 11/18; A63C 11/20
USPC ..... 280/809, 811
See application file for complete search history.

(56) References Cited

U.S. PATENT DOCUMENTS

| | | | | | |
|---|---|---|---|---|---|
| 1,998,702 | A * | 4/1935 | Boline | 280/609 |
| 2,153,809 | A * | 4/1939 | Meis | 280/619 |
| 2,242,156 | A * | 5/1941 | Wallace | 280/601 |
| 2,933,324 | A * | 4/1960 | Stimler | 280/637 |
| 3,313,046 | A * | 4/1967 | Darr et al. | 36/118.4 |
| 3,545,106 | A * | 12/1970 | Hans | 36/117.1 |
| 3,727,934 | A * | 4/1973 | Averbook et al. | 280/814 |
| 3,804,429 | A * | 4/1974 | Rovatti | 280/817 |
| 3,884,488 | A * | 5/1975 | Riedel | 280/637 |
| 3,897,839 | A * | 8/1975 | Brisebois | 180/190 |
| 3,994,511 | A * | 11/1976 | Gronseth | 280/614 |
| 4,055,287 | A | 10/1977 | Champenois, Jr. | |
| 4,259,791 | A * | 4/1981 | Bazan | 36/7.2 |
| 4,353,573 | A * | 10/1982 | Morgan | 280/606 |
| 4,409,287 | A | 10/1983 | Harrison | |
| 4,616,842 | A * | 10/1986 | Echevin et al. | 280/602 |
| 4,674,787 | A | 6/1987 | DeVera | |
| 4,907,817 | A * | 3/1990 | Schwarz | 280/615 |
| 5,106,118 | A * | 4/1992 | Frey | 280/636 |
| 5,172,924 | A * | 12/1992 | Barci | 280/14.22 |
| 5,310,221 | A * | 5/1994 | Schmidt | 280/809 |
| 5,636,856 | A * | 6/1997 | Luitz et al. | 280/607 |
| 6,063,739 | A * | 5/2000 | Geissbuhler | 508/106 |
| 6,331,008 | B2 * | 12/2001 | Cormican | 280/22 |
| 8,128,102 | B1 * | 3/2012 | Brown | 280/18.1 |
| 2011/0012335 | A1 * | 1/2011 | Jones | 280/809 |

FOREIGN PATENT DOCUMENTS

| | | | | |
|---|---|---|---|---|
| CH | 608379 A5 * | 1/1979 | | A63C 9/18 |

* cited by examiner

*Primary Examiner* — Katy M Ebner
(74) *Attorney, Agent, or Firm* — George S. Levy

(57) ABSTRACT

A snow deflector for skis comprises a structure elongated along the ski, mounted on the top surface of the ski and convex at the top. An implementation with an A-shaped cross-section includes installing a cable between the boot and the ski tip, wrapping fabric over the cable and attaching the fabric to the edges of the ski. Other implementations include forming this convex structure with foam, fiberglass or carbon fibers. Yet another implementation utilizes a frame over which the fabric is draped. Yet another implementation utilizes an inflatable structure.

13 Claims, 13 Drawing Sheets

SNOW DEFLECTOR FOR SKIS

This invention claims the benefit of U.S. Provisional Application No. 61/606,732 with the title, "Snow Deflector for Skis" filed on Mar. 5, 2012 and which is hereby incorporated by reference. Applicant claims priority pursuant to 35 U.S.C. Par 119(e)(i). The present invention relates to skis, more particularly to means for preventing snow accumulation on the top surfaces of skis.

FIELD OF THE INVENTION

Background

Skis should be as light as possible to facilitate skiing. Modern technology has reduced their weight by using newly developed strong and light materials such as carbon fibers. Yet skis are often weighted down by snow that accumulates on their top surfaces. This weight can be a burden to skiers especially when they are climbing uphill. Special low friction coatings can be applied to the ski's top surfaces but these coatings are often insufficient to prevent snow build up especially in certain snow conditions.

One of the main reasons for the snow accumulation is that the top surfaces of skis are essentially horizontal. Yet we know from alpine architecture that one of the best methods for preventing snow accumulation on top of buildings is to construct A-shaped or convex roofs rather than flat horizontal roofs.

There is a need for an efficient lightweight method or device for preventing snow accumulation on top of skis.

Further features, aspects, and advantages of the present invention over the prior art will be more fully understood when considered with respect to the following detailed description and claims.

SUMMARY OF THE INVENTION

This invention is a snow deflector that prevents the accumulation of snow on the top surfaces of skis. It is essentially an elongated structure with a top surface which is convex (for example A-shaped or rounded) in the cross-sectional direction perpendicular to its long axis. It can be mounted either removably or permanently to the front surface of a ski. It is of great utility to skiers in lightening up the weight of the ski when they are climbing uphill or going cross-country.

Several implementations of this invention are presented. The first is a cable and fabric structure mounted on the front part of the skis between the front tip and the boot and between the two edges. The cable is attached tightly between the tip of the ski and the boot and the fabric is draped over it, giving the structure an A-shape. The second implementation comprises a solid foam body or hollow fiberglass or carbon fiber body, mounted in front of the ski bindings and elongated along the axis of the ski. Its top surface is round-convex. The third implementation is a solid foam body or hollow fiberglass or carbon fiber body, elongated along the axis of the ski. Its top surface is A-shaped-convex. The fourth implementation makes use of an A-shaped foldable frame to support fabric. The fifth implementation utilizes a fabric cover supported by triangular riggings snap-mounted on top of the ski and held in place by taut tension cables between the tip of the ski and an anchor mounted on the ski just in front of the bindings. Yet a sixth implementation makes use a rigid A shell attached to the ski by hook-and-loop fasteners.

DETAILED DESCRIPTION

The invention is depicted in the figures. It is comprised essentially of a structure which is elongated along the axis, and attached to the front of, the ski. The structure has a convex surface at the top, configured to deflect and prevent the accumulation of snow. The term convex is interpreted to include A-shapes as well as rounded surfaces.

Figure 1:
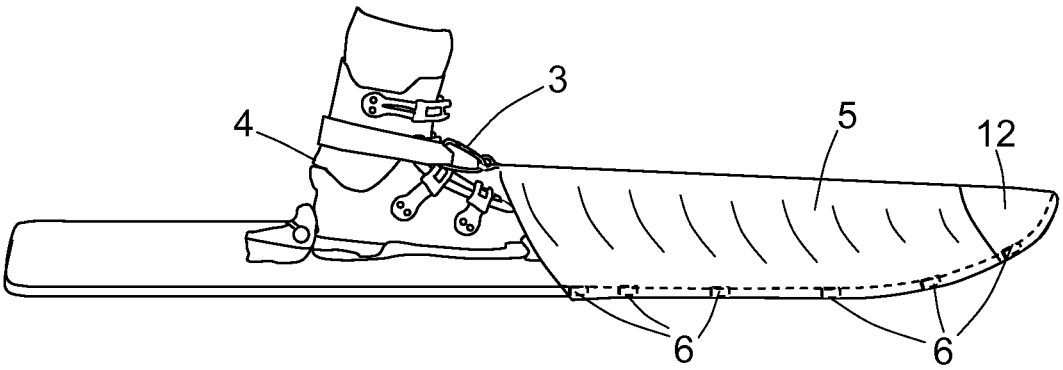
FIG. 1 illustrates an implementation of the invention, using a cable attached between the tip of the ski and the boot. A fabric is draped over the cable to produce an A-shaped structure.

FIG. 1 illustrates a possible embodiment of this invention. The deflecting structure comprises a taut center cable 1 attached at one of its ends to the front tip 2 of the ski. The center cable 1 is attached at its other end by means of a hook 3 or the like, to the skiing boot 4 of the skier. The hook 3 could, for example, include a carabiner for ease of attachment and detachment. The center cable 1 could be conveniently attached by means of a hook to one of the boot buckles, preferably to one of the lower buckles to avoid interfering with the movement of the ankle. The center cable 1 can be made of metal (e.g., steel), plastic (e.g., nylon) or elastic material (e.g., bungee cord.) A waterproof and elastic fabric 5 is draped over the center cable 1 and covers the ski laterally from edge to edge, and longitudinally from the front of the ski to the bindings. The fabric is attached along the edges of the ski by means of fasteners 6 such as hook-and-loops. If a hook-and-loop fastener is used it is preferable to mount the loops on the fabric and the hooks on the ski edge. The fabric 5 is shaped as a reinforced hood 12 which fits at the front tip of the ski.

Figure 2:
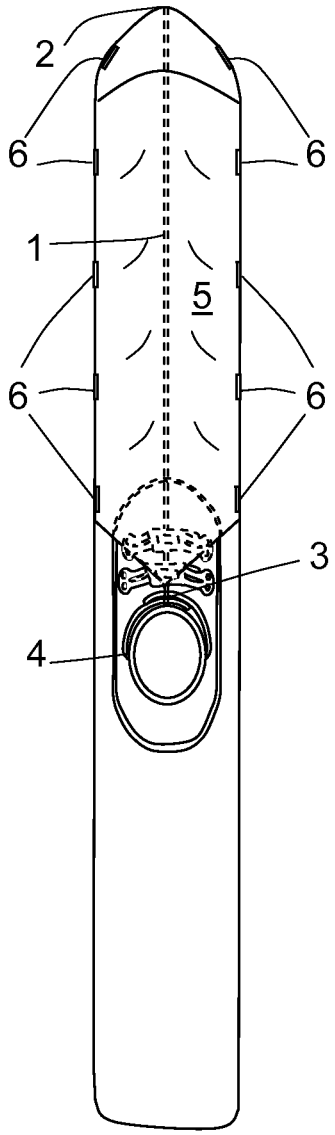
FIG. 2 provides a top view of the cable and fabric implementation.
Figure 3:
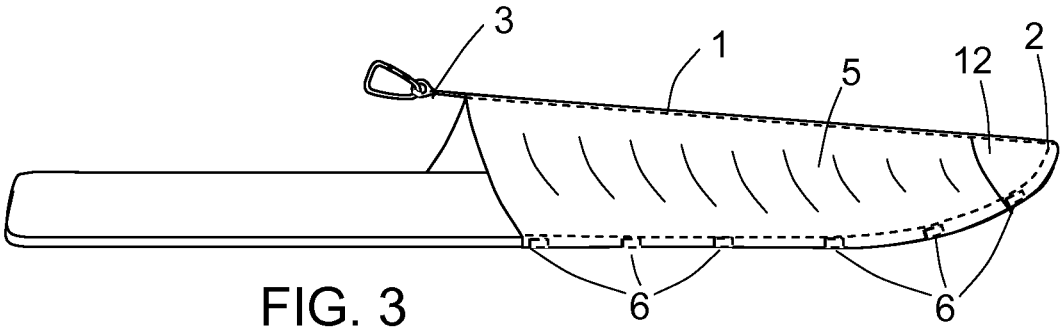
FIG. 3 shows the cable and fabric implementation without the ski boot to better clarify the cable attachment method to the boot and the fabric attachment method to the ski edges.
Figure 3A:
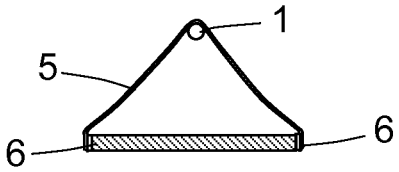
FIG. 3A provides a cross sectional view of the cable and fabric implementation showing the cross-sectional A-shape.
Figure 3B:
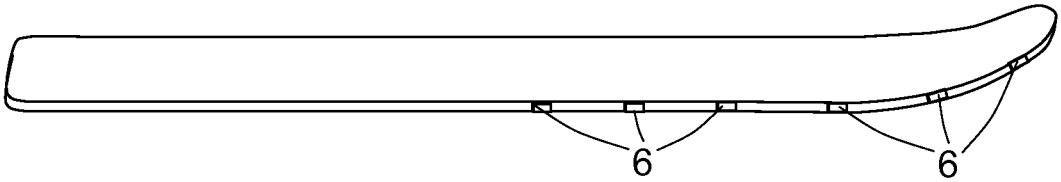
FIG. 3B shows the ski and the hook-and-loop fasteners.

FIG. 2 shows a top view of this embodiment. FIG. 3 shows the embodiment without the boot to clarify further the attachment method. The center cable 1 can be attached by means of a hook to the ski boot 4. The fabric 5 can be attached to the ski edges by means of hook-and-loops fasteners 6. FIG. 3A shows the A shaped cross-sectional view of the device, which is suitable for deflecting snow. FIG. 3B shows the hook-and-loop fasteners 6 mounted along the edges of the ski.

Usage of the device. Typically the device would be removed for downhill skiing and put in place for climbing uphill or for cross country skiing. The cable and fabric construction of this embodiment makes the device easy to fold and carry.

Figure 4:
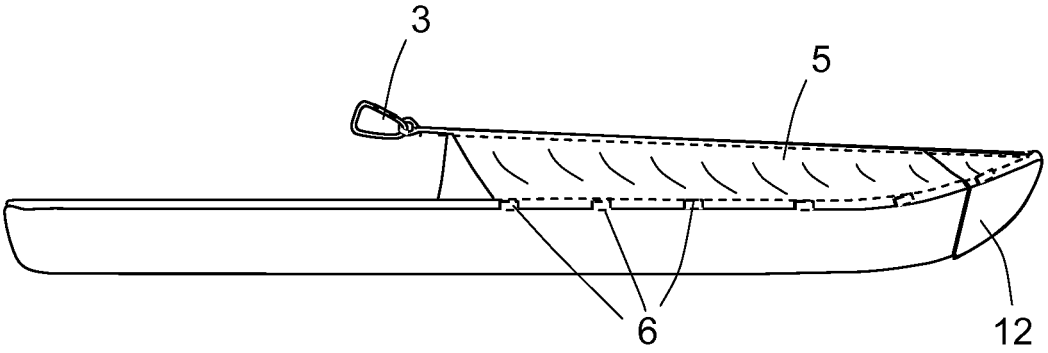
FIG. 4 provides a bottom view of the ski showing the reinforced hood.

FIG. 4 provides a bottom view of the ski showing how the fabric 5 can be configured with a reinforced hood that covers the tip of the ski.

Figure 5:
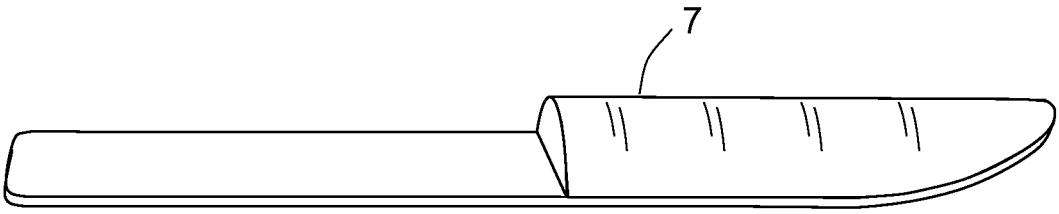
FIG. 5 illustrates an implementation with a rounded top.
Figure 5A:
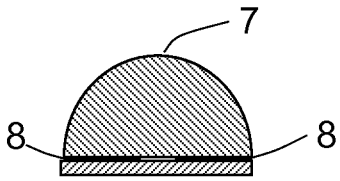
FIG. 5A provides a cross sectional view of the convex implementation using solid foam.
Figure 5B:
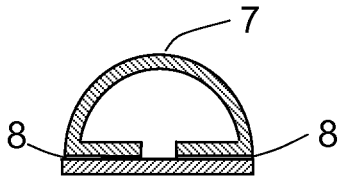
FIG. 5B provides a cross sectional view of the rounded implementation using hollow carbon or glass fibers.

FIGS. 5, 5A and 5B illustrate a different implementation. The snow deflecting structure has a rounded top 7 which is configured to deflect snow. It is attached by means of hook-and-loop fasteners 8, or can be permanently bonded, to the top front surface of the ski. FIGS. 5A and 5B show the device in cross-section. This structure can be made of a semi-rigid and light material such as plastic foam as shown in FIG. 5A. Alternatively the structure can be made hollow of glass fibers or carbon fibers bound together with resin as shown in FIG. 5B.

Figure 6:
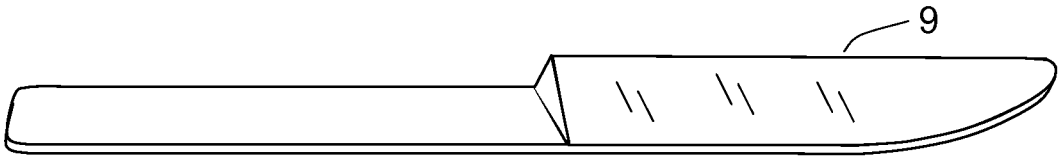
FIG. 6 illustrates an A-shaped implementation comprised of solid material such as foam, glass fibers with resin or carbon fibers with resin.
Figure 6A:
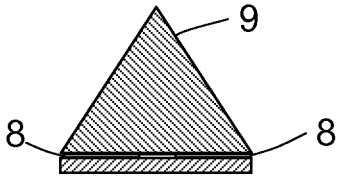
FIG. 6A provides a cross sectional view of the A-shaped implementation using solid foam.
Figure 6B:
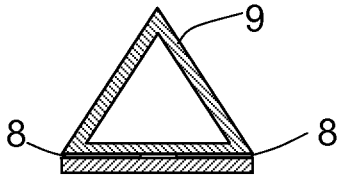
FIG. 6B provides a cross sectional view of the hollow A-shaped implementation using hollow carbon or glass fibers.

Another embodiment is illustrated in FIGS. 6, 6A and 6B. It is very similar to the ones shown in FIGS. 5, 5A and 5B except that the top surface of the snow deflector is A-shaped 9 rather than being rounded.

Figure 7:
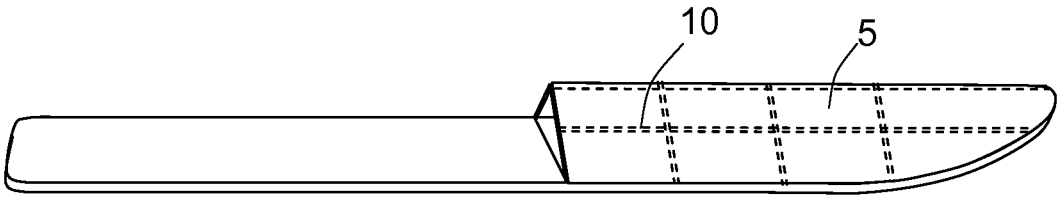
FIG. 7 illustrates how the snow deflecting structure can be constructed with a lightweight foldable frame covered with fabric.
Figure 7A:
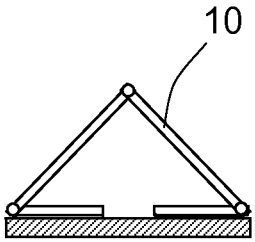
FIG. 7A provides a cross sectional view of the lightweight frame implementation.
Figure 7B:
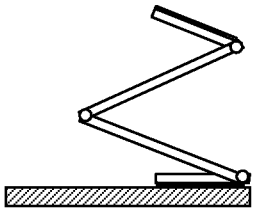
FIG. 7B shows a partially folded frame implementation.

Yet another implementation is shown in FIGS. 7, 7A and 7B. The structure comprises a lightweight A-shaped frame 10 over which fabric 5 is draped. The frame 10 includes articulations to adjust it for size and make it possible for it to be compactly folded. As discussed earlier, the fabric 5 can be attached to the edges of the ski by means of hook-and-loop fasteners.

To further improve the performance of the invention, the convex structure can be coated with a low adhesion layer or wax thereby reducing the possibility that snow sticks to it.

A range of angles are possible for the A-shaped implementation. For example an angle of 120 degrees would be less obtrusive but would not deflect snow very well. An angle of 30 degrees would be very obtrusive but could deflect snow very well.

Figure 8:
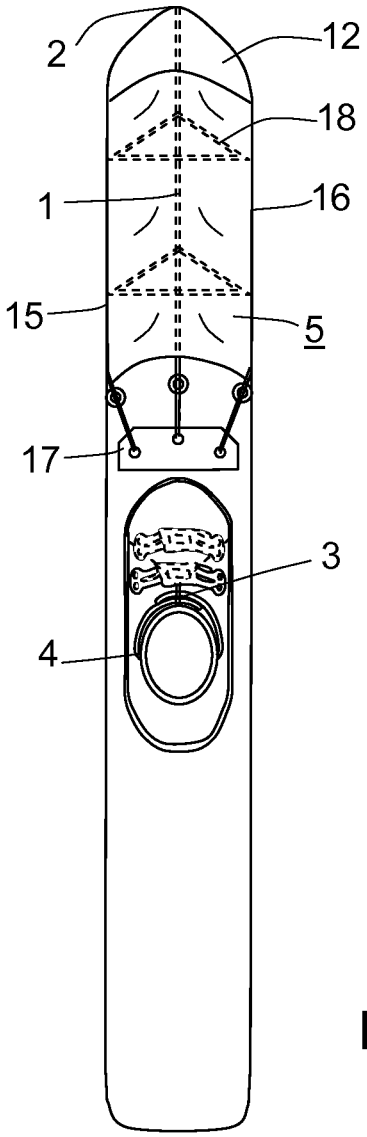
FIG. 8 shows an implementation wherein the fabric is supported by one or more triangular frames which are held in place by three tension cables.

Yet another variation is shown in FIG. 8. The fabric 5 is supported by the center cable 1, a right cable 16 and a left cable 15. The cables are attached at one of their front ends to the hood 12. At their back end, they are anchored to a metal plate 17 positioned at the rear of the snow deflector, just in front of the ski binding. All cables are adjustable in length and typically can be made of shock cord or similarly elastic material.

The metal plate 17 is permanently affixed to the ski with reinforcing self-tapping screws and adhesive backing. This plate has hook points to allow the three tension cables 1, 15 and 16 to be attached. There is one hooking point on the left side, and one on the right side to attach the left and right tension lines respectively. There is also one hooking point in the center to attach the primary tension line at the top of the ski deflector. The metal plate 17 eliminates the need for a ski boot attachment and allows the height of the deflector to be controlled by triangular frames of "rigging" 18 which support the fabric 5.

Figure 9:
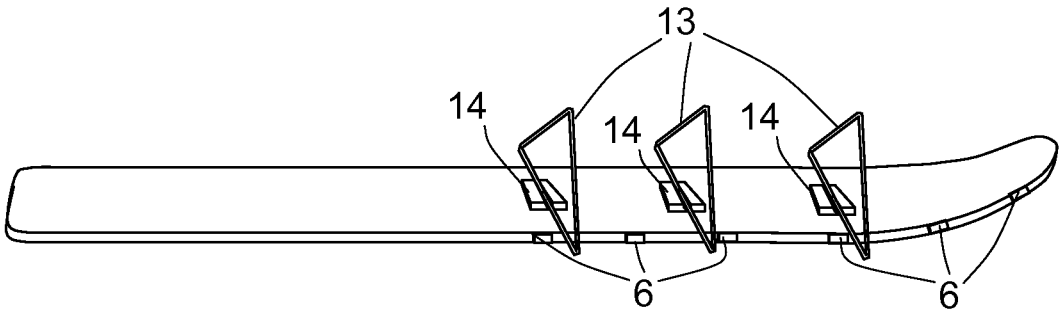
FIG. 9 shows the triangular frames.
Figure 9A:
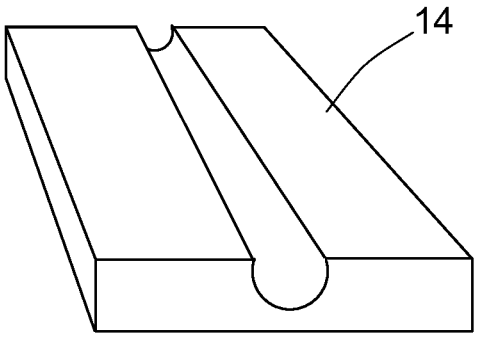
FIG. 9A provides a detailed view of the snap-on fasteners for the triangular frames.

The rigging 18 forms a frame made of one or more triangulated pieces of tubing that reinforce the inside of the deflector. This frame is shown in greater detail in FIG. 9. It is constructed of small plastic tubes, 13 adjustable in length to accommodate different ski shapes, and fits through sleeves sewn inside the fabric 5 along the sides of the deflector. The tubes 13 will also snap into place into couplings 14 shown in FIG. 9A fastened in the middle of the ski.

The front end of the fabric 5 comprises a hood 12 that fits on the front tip of the ski. This hood is stretchable fitting at the ski tip to accommodate the widest possible range of ski tip shapes. It is also long enough to seal out snow penetration but not long enough to affect ski glide along the bottom of the ski. Typically it extends about 4-7 inches from the tip along the bottom of the ski.

Figure 10:
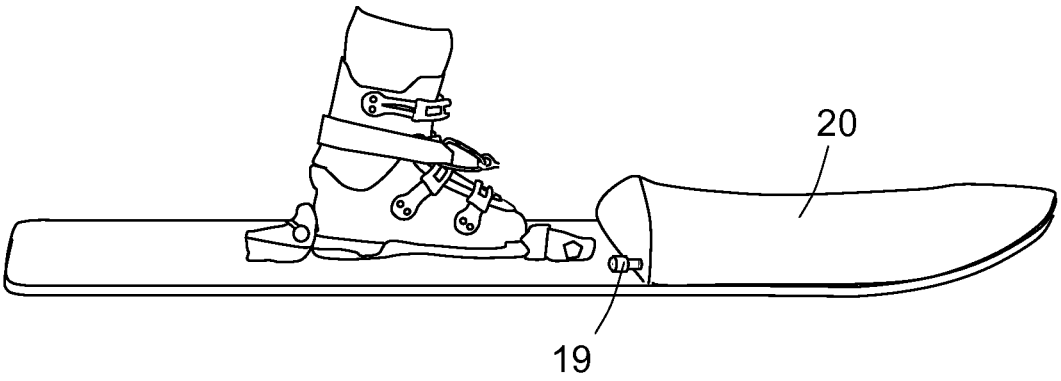
FIG. 10 illustrates an inflatable implementation.

Yet one more embodiment utilizes an inflatable construction. As shown in FIG. 10, the deflecting structure 19 can be made of inflatable with valve 20 allowing the skier to inflate it for use or deflate it for storage and transportation. The inflatable structure is attached to the top of the ski by means of fasteners such as hook and loop fasteners, snap-on fasteners.

Figure 11:
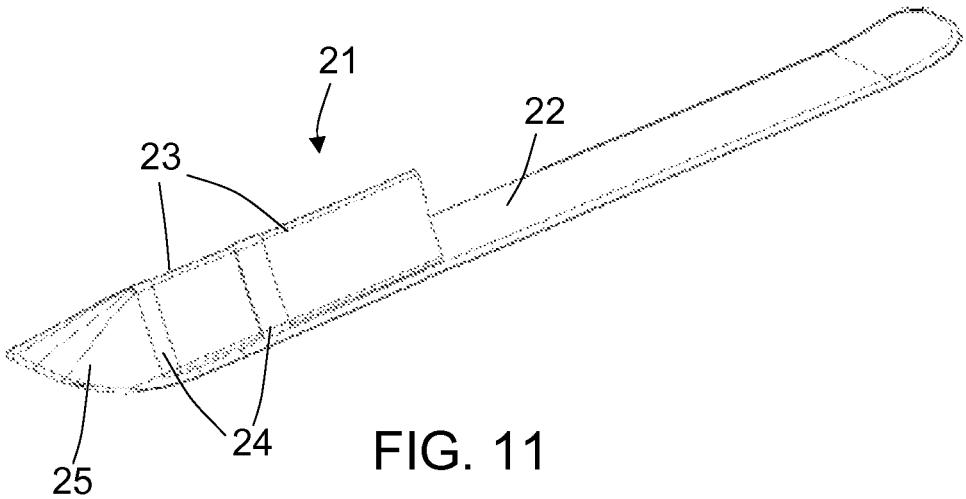
FIG. 11 shows yet another implementation using a rigid A shell attached to the ski by hook-and-loop fasteners.
Figure 12:
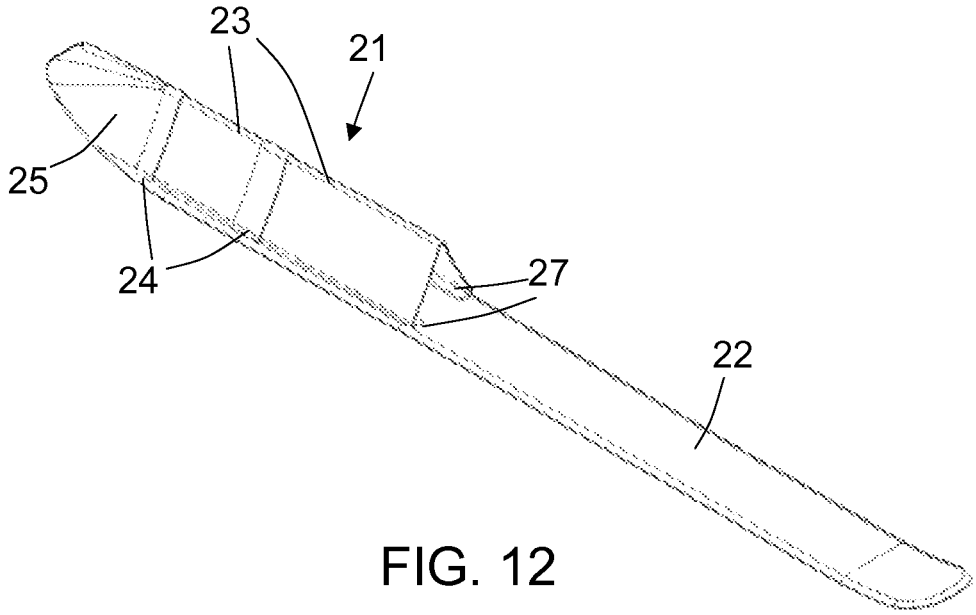
FIG. 12 provides another view of the implementation using a rigid A shell attached to the ski by hook-and-loop fasteners.
Figure 13:
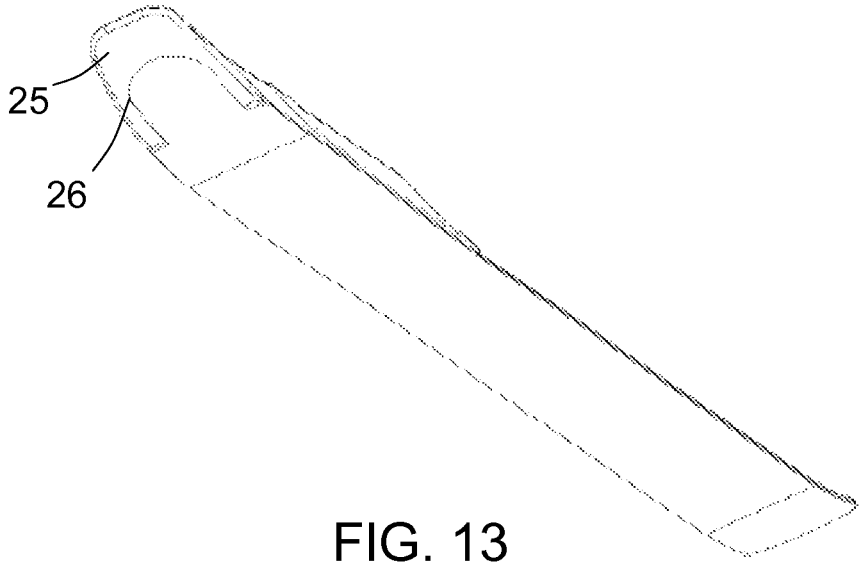
FIG. 13 shows a bottom view of the implementation using a rigid A shell attached to the ski by hook-and-loop fasteners.

Another embodiment is shown in FIGS. 11-13. An A-shaped shell 21 is attached along the two legs of the A to the top surface 22 of the skis by means of hook-and-loop fasteners 27. Alternatively snap-in fasteners can be used. This embodiment does not require a frame since the A shell is rigid. The A shell is segmented along its length, and the segments 23, are joined by bands 24 of flexible and stretchable membranes to match the ski's flexibility. The segmented design (rigid segments joined by flexible membranes) approach has the advantage of allowing the ski to flex and absorb the rigorous dynamic stress produced during skiing. Another advantage is that segments can be added or removed to fit different ski sizes.

A sock 25 also of flexible material is used to secure the device to the top of the ski. A plastic rib 26 extending underneath the top edge from the plastic holds the sock 25 in place. Configuring the device with an elastic sock on the front/nose portion of the ski has the advantage of a universal fit to skis with different designs and shapes. The sock serves not only to hold the structure together but to deflect the snow as the ski travels through it.

While the above description contains many specificities, the reader should not construe these as limitations on the scope of the invention, but merely as exemplifications of preferred embodiments thereof. Those skilled in the art will envision many other possible variations within its scope. Accordingly, the reader is requested to determine the scope of the invention by the appended claims and their legal equivalents, and not by the examples which have been given.

I claim:

1. A ski equipped with a snow deflector, said ski comprising a front tip, a right edge, a left edge, and a ski boot, furthermore said ski also comprising a structure elongated along a long axis of said ski and mounted on a top surface of said ski, said structure having a convex top surface in the cross-sectional direction perpendicular to said axis, said structure extending on the front part of the ski between the front tip of said ski and the boot and between the two edges, said structure comprising:

a. a cable tightly tethered from said front tip to said ski boot;

b. a fabric wrapped over said cable and attached to said ski edges;

said fabric and said cable configuring said structure into an A-shape.

2. The ski of claim 1 wherein said fabric is attached to said ski edges by hook-and-loops fasteners.

3. The ski of claim 1 wherein said structure comprises a foldable frame covered by said fabric wrapped over said foldable frame and fastened to said ski.

4. The ski of claim 1 wherein said structure is removably mounted on said ski.

5. The ski of claim 1 wherein said structure is permanently mounted on said ski.

6. The ski of claim 1 wherein said structure is coated with a low adhesion layer.

7. The ski of claim 1 wherein said structure is mounted between said front tip and said ski boot.

8. The ski of claim 1 wherein said structure has an A-shaped top surface in the cross-sectional direction perpendicular to said axis.

9. The ski of claim 8 wherein said A-shaped top has an angle between 120 degrees and 150 degrees.

10. The ski of claim 8 wherein said A-shaped top has an angle between 90 degrees and 120 degrees.

11. The ski of claim 8 wherein said A-shaped top has an angle between 60 degrees and 90 degrees.

12. The ski of claim 8 wherein said A-shaped top has an angle between 45 degrees and 60 degrees.

13. The ski of claim 8 wherein said A-shaped top has an angle between 30 degrees and 45 degrees.

* * * * *